United States Patent [19]

Hahn

[11] 4,359,069

[45] Nov. 16, 1982

[54] LOW DENSITY MULTILAYER PAPERMAKING FABRIC

[75] Inventor: Edward R. Hahn, Neenah, Wis.

[73] Assignee: Albany International Corp., Albany, N.Y.

[21] Appl. No.: 182,090

[22] Filed: Aug. 28, 1980

[51] Int. Cl.[3] ..... D03D 15/00; D21F 1/10; B01D 39/10

[52] U.S. Cl. ..... 139/425 A; 139/383 A; 162/DIG. 1

[58] Field of Search ..... 139/425 A, 383 A, 420 R, 139/383 AA; 162/DIG. 1, 348, 349; 245/8

[56] References Cited

U.S. PATENT DOCUMENTS 3,296,062 1/1967 Truslow .
3,885,602 5/1975 Slaughter .
3,885,603 5/1975 Slaughter .
4,041,989 8/1977 Johansson et al. .
4,071,050 1/1978 Codorniu .
4,086,941 5/1978 Thompson .
4,112,982 9/1978 Bugge et al. .
4,171,009 10/1979 Karm .
4,314,589 2/1982 Buchanan et al. .

FOREIGN PATENT DOCUMENTS 27716 4/1981 European Pat. Off. ..... 139/383 A

*Primary Examiner*—James Kee Chi
*Attorney, Agent, or Firm*—Quarles & Brady

[57] ABSTRACT

A papermaking fabric of the multilayer type having threads of a multiple layer thread system extending in one fabric direction and threads of a single layer thread system extending in the other fabric direction which are interwoven with the threads of each of the multiple layers. The threads of the single layer thread system are spaced apart from one another, and threads of the several layers are tiered above one another with spacing between tiers, so that the fabric has a significant projected open area that allows spray water to penetrate the fabric. The fabric may also have an increased void volume in its interior and binding points between thread systems that are well spaced from one another to enhance the papermaking qualities of the fabric.

15 Claims, 6 Drawing Figures

FIG.1
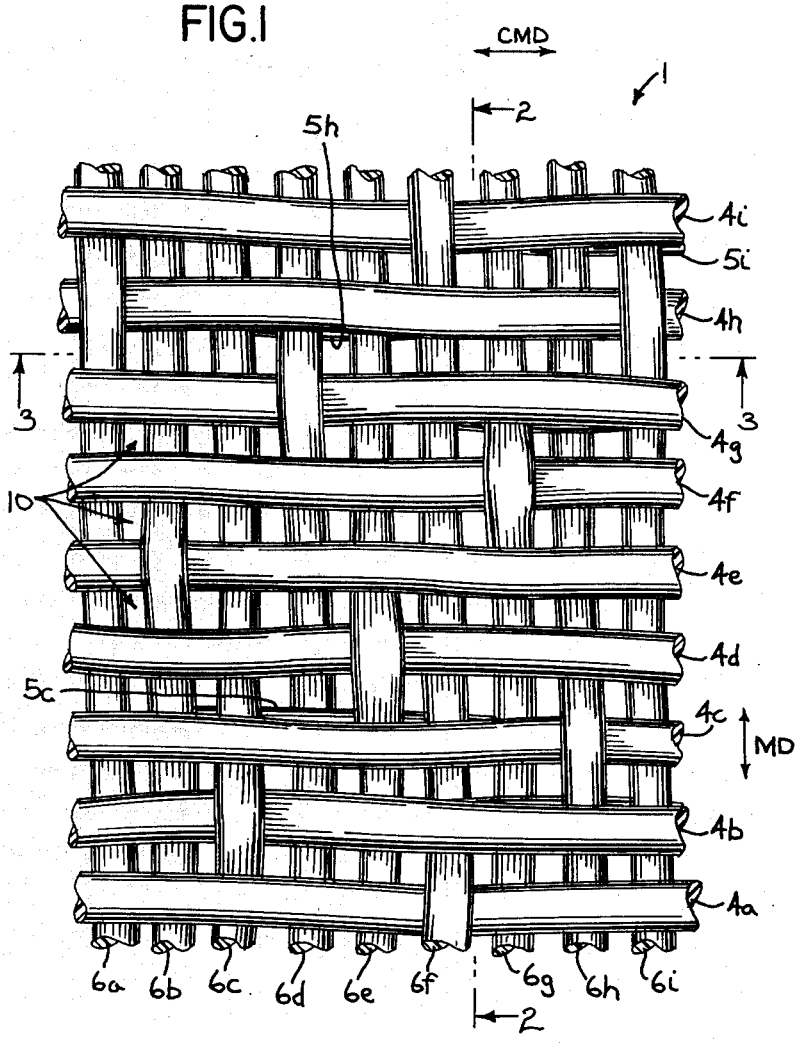
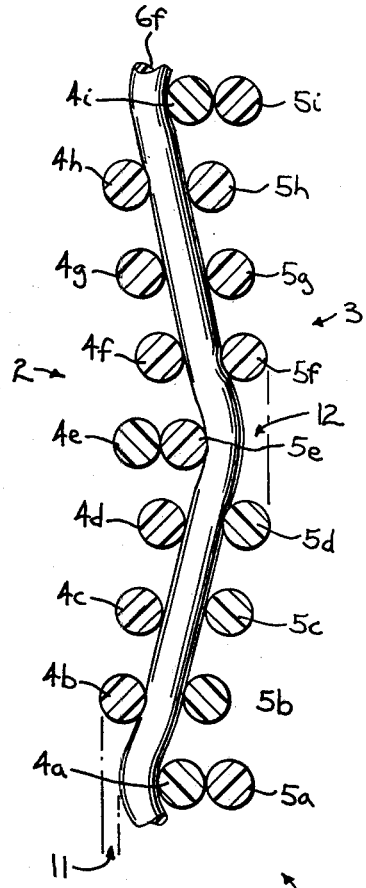
FIG. 2
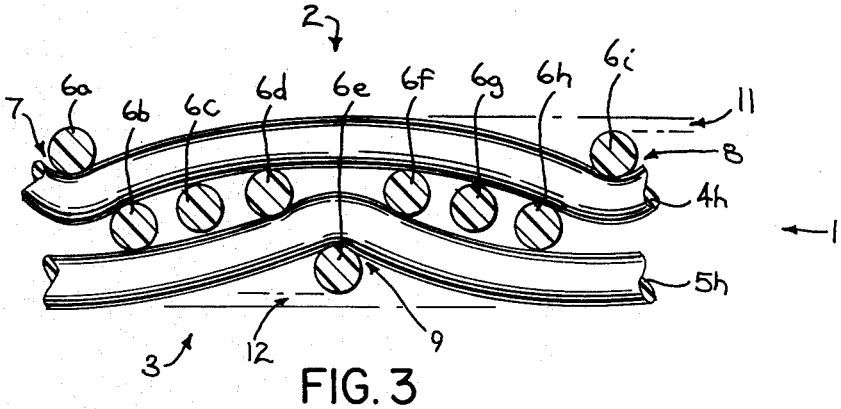
FIG. 3

LOW DENSITY MULTILAYER PAPERMAKING FABRIC

BACKGROUND OF THE INVENTION (a) Field of the Invention

This invention relates to papermaking fabrics, and more particularly to multilayer fabrics characterized by threads of a multiple layer thread system extending in one fabric direction and threads of a single layer thread system extending in the other fabric direction, such single layer threads being interwoven with the threads of each layer of the multiple layer system.

(b) Description of the Prior Art

In recent years there has been an increasing use of multilayer fabrics in the wet, or forming end of papermaking machines. Such multilayer fabrics supplant single layer fabrics that consist of a single layer of longitudinally extending threads interwoven with a single layer of transversely extending threads. The multilayer fabrics can provide special advantages, such as improved stretch resistance to tension loads imparted by a papermaking machine, resistance to crimp interchange between longitudinal and transverse thread systems, greater stiffness that reduces wrinkling of the fabric, better paper sheet support and longer wear life. Because of these advantages the use of multilayer fabrics has been increasing.

Multilayer fabrics usually have one thread system comprised of two layers of threads extending transversely, or crosswise to the machine or running direction of the fabric, with each thread of the upper layer being paired with and lying directly above a thread of the lower layer. A second thread system comprises a single layer of threads extending in the longitudinal, or machine direction of the fabric, and each of these threads is interwoven with the threads of both layers of the two layer thread system. Over the years such multilayer fabrics have been steadily improved and refined to enhance their papermaking qualities. Several of these improvements have concerned the development of preferred crimp relationships between the two thread systems. For example, in U.S. Pat. No. 4,071,050 issued on an application filed July 16, 1973, the longitudinally extending threads of the single layer thread system are interwoven with the upper layer of the two layer thread system in such manner that upon stretching the fabric during manufacture the thread knuckles of both thread systems on the upper fabric surface come into a nearly common plane to achieve a better paper forming surface. In U.S. Pat. No. 4,041,989 issued on an application filed Sept. 30, 1975, the knuckles of longitudinally extending threads of the single layer thread system are receded into the fabric on the lower fabric surface to expose the threads of the lower layer of the two layer thread system as the primary wearing elements of the fabric. And, in U.S. Pat. No. 4,112,982 issued on an application filed Feb. 17, 1977, the number of crossovers of the transversely extending threads of the upper layer of the two layer thread system are increased to develop a paper forming surface comprised primarily of long crosswise thread knuckles to decrease paper marking.

Some additional multilayer fabric structures are shown in U.S. Pat. No. 4,086,941 issued on an application filed Oct. 26, 1976, wherein a two layer thread system consisting of shute threads has the threads of one layer horizontally offset from the threads of the other layer, and in U.S. Pat. No. 4,171,009 issued on an application filed Mar. 22, 1977, in which long knuckles are formed in the single layer thread system on the paper-forming side of the fabric by having these threads bind with three to seven threads of the upper layer of the multiple layer thread system. Besides the development of multilayer papermaking fabrics characterized by a single layer thread system extending in one fabric direction, some work has also been done on multiple ply fabrics, as shown in U.S. Pat. Nos. 3,885,602 and 3,885,603. In these fabrics each ply has its own interwoven longitudinal and transverse thread systems, and the plies are tied together with threads interweaving between both plies. Such multiple ply fabrics have not achieved widespread usage as have the multilayer fabrics.

Heretofore, multilayer fabrics have been constructed with very high thread densities for the single layer thread system, in order to achieve dimensional stability and to minimize shifting of threads within the fabric. Thread density can be measured by multiplying the number of threads per unit width of fabric by the thread diameter, and for the single layer thread system the densities have commonly run near a value of 1.0. As examples, FIG. 3A of the aforesaid U.S. Pat. No. 4,112,982 shows the threads of the single layer system lying side by side, and in U.S. Pat. No. 4,171,009 the density is stated at Col. 3, line 15 as being 1.05 and above. This requirement of a high thread density for the single layer thread system can inhibit "knock-off" water showers from loosening edge trim of a paper web from the fabric after it passes the couch roll of a paper forming machine, and in machines where this trim removal requires assistance in being stripped from the forming fabric multilayer fabrics are not widely used. This has been a particular problem in the manufacture of brown papers including linerboard, which is one of the major products of the papermaking industry. Another problem with a dense fabric is that closely adjacent threads abutting one another are prone to hold and collect contaminants in the paper pulp or furnish. This makes cleaning of the fabric more difficult as contrasted with a more open weave. Greater downtime of the papermaking machine may be required to remove the contaminants, or if cleaning is not properly conducted the useful life of a fabric may be shortened. For these reasons multilayer fabrics have found limited usage in the production of certain paper grades.

Multilayer fabrics can also present quite different characteristics on a papermaking machine than the previously used single layer fabrics which they supplant, and these differences can give rise to problems in the replacement of the single layer type construction with multilayer design. The thickness and bulk of the multilayer fabrics present different drainage and flow characteristics, and fiber support and retention may also be different, so that adjustments may be necessary in the papermaking process to accommodate multilayer fabrics in installations where the more conventional single layer fabrics have been used. For some papermaking it consequently would be desirable to design multilayer fabrics with characteristics that are more similar to those of single layer fabrics.

SUMMARY OF THE INVENTION

The present invention relates to multilayer fabrics for papermaking, and it more specifically resides in a fabric having threads of a multiple layer thread system extending in one direction of the fabric that are interwoven with threads of a single layer thread system that extends in a direction normal to the threads of the multiple layer system, and in which the single layer threads are spaced from one another to provide a projected open area for the fabric that is in the range of about 13 to 25 percent of the total fabric area.

The design of a satisfactory papermaking fabric is a complex undertaking involving several interrelated factors. It is necessary to obtain proper knuckle heights on both surfaces of the fabric. On the lower, or wear surface that travels over and around the component parts of the associated papermaking machine it is normally desirable to have floats or knuckles of the cross machine threads predominate, so as to withstand abrasion and take the physical wear to which a fabric is subjected. The machine direction threads are then recessed from the outermost fabric surface formed by the knuckles of the cross machine threads, so as to retain a greater percentage of their cross section area throughout fabric life and thereby better withstand the longitudinal stresses that are imposed upon the fabric in driving it around the rolls, foils and suction boxes of the paper machine. On the upper, or paper supporting surface of the fabric it is desirable to have the thread knuckles provide sufficient support areas for the paper sheet being formed to obtain good release of the sheet from the fabric. For some papers the spacing and heights of the knuckles should be arranged to minimize marking. The relative knuckle lengths and heights of the machine direction and cross machine direction threads can also affect fiber orientation, which may produce different paper characteristics. The design of a fabric should also provide uniform drainage and uniform fiber support across the fabric surface. To obtain such uniformity it is desirable to have the threads of both thread systems extend substantially straight, when viewed in the plane of the fabric, with minimal lateral crimp, in order to maintain uniform spacing between threads. The threads of the two systems should also satisfactorily interlock with one another where they bind at cross-over points to develop stability and prohibit relative shifting of the threads.

Another design factor of a fabric is its permeance to water flow. The drainage rate and turbulence of water flowing through a fabric may have an effect upon the papermaking qualities of a fabric. For example, drainage rates are a factor in determining the amount of water that can be included in the furnish. For a more open fabric with a higher rate of drainage more water can be used while maintaining the same degree of water content in the paper web at the point where the paper sheet releases from the fabric. With the use of more water, a better dispersion of fibers can be achieved to enhance the paper being produced.

These various factors have been accommodated in the multilayer fabric of the present invention. A major improvement has been a reduction in the volume of thread material used in the single layer thread system, which system preferably extends in the longitudinal, or machine direction of the fabric. This reduction of thread material in the single layer thread system is achieved by spacing the single layer threads from one another. The reduction in thread material opens up the fabric to develop openings extending straight through the full depth of the fabric. Such openings present direct lines of sight through the fabric which define a projected open area for the fabric. Thus, there are direct paths for water drainage that distinguish from the more tortuous water flow paths in prior multilayer papermaking fabrics. The openings allow water sprays to pass directly through the fabric to augment release of paper trimmings from the fabric, and to improve the cleaning characteristics of the fabric. Also, the increased drainage rate that can be obtained allows the papermaker to either add water to his furnish to improve fiber dispersion, or to operate a machine at a faster speed.

In preferred embodiments of the invention, the threads in both thread systems have minimal lateral crimp so as to extend substantially straight as viewed in the plane of the fabric. Also, threads in the multiple layer thread system are grouped together in pairs that comprise a thread from an upper layer tiered above a thread from a lower layer, so that threads of a group are in a stacked relation with minimal deviation from vertical alignment. These characteristics of straight threads and vertical stacking develop uniform, rectangular openings throughout the fabric to achieve uniform drainage and fiber support.

In providing these advantages, the invention also can incorporate long floats on the paper side for good fiber support, recessed longitudinal threads on the wear side, adequate knuckle formation to bind the threads in place and dimensional stability. The resulting fabric is particularly suited as a forming medium for the production of liner board and similar heavy papers. Thus, the advantages of multilayer fabrics are extended to a large segment of paper production.

It is an object of the invention to provide a multilayer papermaking fabric with a significant projected open area in order to function with water sprays for improving the knock-off of edge trimmings.

Another object of the invention is to reduce fabric contamination, and still further objects are to provide a fabric having desirable knuckle formation for good papermaking qualities, good drainage and flow characteristics, and substantially rectangular openings of like size throughout the fabric to have uniform support for paper fibers and the sheet being produced.

The foregoing and other objects and advantages of the invention will appear from the following description. In the description, reference is made to the accompanying drawings which form a part hereof, and in which there is shown by way of illustration and not of limitation a preferred embodiment of the invention. Such embodiment does not represent the full scope of the invention, and reference is made to the claims herein for interpreting the breadth of the invention.

BRIEF DESCRIPTION OF THE DRAWINGS

FIG. 1 is a plan view of a fragmentary portion of a papermaking fabric of the invention showing the paper forming surface of the fabric, FIG. 2 is a view in section taken through the plane 2—2 indicated in FIG. 1 to illustrate the general contour of a thread in the single layer thread system of the fabric, FIG. 3 is a view in section taken through the plane 3—3 indicated in FIG. 1 to show the general contours of a pair of stacked threads in the upper and lower layers of the multilayer thread system of the fabric.

DESCRIPTION OF THE PREFERRED EMBODIMENT

Figure 4:
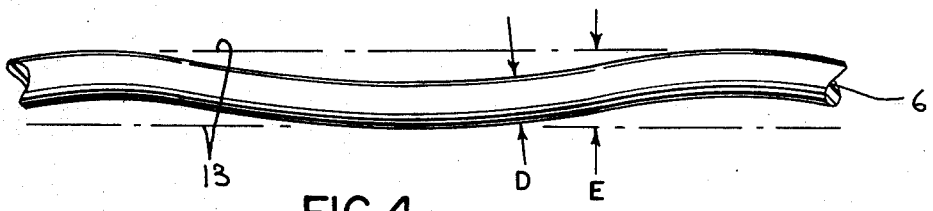
FIG. 4 is a top view of a single thread to illustrate the nature of lateral crimp in a thread.

Referring to FIG. 1, there is shown a fragmentary portion of a paperforming fabric 1 of the present invention suitable for use in the forming, or wet end of a papermaking machine. As is usual in the manufacture of papermaking fabrics, the fabric is woven on a loom from suitable synthetic threads and is fashioned into a large endless belt that is heat treated and stretched to set the individual threads into their final configurations. However, different materials, both synthetic and natural as well as metal, can be employed if found satisfactory, and the invention is not restricted in this regard or the manner of weaving and finishing of the fabric. The fabric 1 has a paper supporting surface comprising the outer face of the endless belt, and it is this surface that is seen in FIG. 1. This surface is also indicated in FIGS. 2 and 3 by the numeral 2, and in the description herein it may be referred to as the upper surface although on the return path in a papermaking machine it may be facing downwardly. The opposite face of the fabric that is on the inside of the endless belt is known as the wear surface, and it travels over rolls, suction boxes and foils of the papermaking machine. In FIGS. 2 and 3 it is indicated by the numeral 3, and this wear surface may be referred to as the lower surface of the fabric to distinguish from the upper forming surface. In FIG. 1 a first double headed arrow labeled MD indicates the machine direction of a papermaking machine upon which the fabric 1 may be used, and this direction may also be referred to as the longitudinal direction of the fabric. A second double headed arrow labeled CMD refers to the cross machine direction, or the transverse direction of the fabric.

The fabric 1 is of a double layer construction in which the threads in the cross machine, or transverse direction comprise a two layer thread system as illustrated in FIGS. 2 and 3. If the fabric is woven flat in a loom and then subsequently seamed into an endless belt these transverse threads will comprise shute threads extending in the cross machine direction. The fragmentary portion of the fabric 1 shown in the drawings has an upper layer 4 comprised of a set of shute threads 4*a* through 4*i*, and a lower layer 5 comprising a set of shute threads 5*a* through 5*i*. Each thread of the layer 5 is vertically aligned with a thread of the upper layer 4, so that the threads of the upper and lower layers of the multilayer thread system are stacked in groups of two with substantial horizontal spacing between adjacent groups. The machine, or longitudinal direction threads 6*a* through 6*i* comprise a single layer thread system 6 of substantial depth, with each thread 6*a*–6*i* interlacing with both the upper and lower layers of shute threads 4 and 5. In a flat woven fabric the threads 6 will comprise warps that are subsequently seamed at their ends to form a large endless papermaking belt.

The contour of the longitudinal thread 6*f* seen in FIG. 2 is typical of each thread in the single layer thread system, and although the drawings do not represent exact thread shapes they provide close approximations from an actual fabric sample. The thread 6*f* has a weave that is repeated every eight threads of each of the upper layer threads 4 and the lower layer threads 5, or as may be alternatively stated a weave repeat of a thread 6 of the single layer threaded system has sixteen crossovers with the threads of the two layer thread system. By crossover is meant the intersection where a thread of one thread system passes a thread of the other thread system, and a machine direction thread 6 can have two crossovers at a single point where it passes a pair of tiered cross machine threads 4 and 5.

In its weave repeat, the longitudinal thread 6*f* will pass above and around a first thread 4*a* of the upper layer to form a binding point therewith. It then runs under the next successive three threads 4*b*, 4*c*, and 4*d*, so as to be sandwiched between the upper and lower thread layers 4 and 5 as an interior thread. Next, the longitudinal thread 6*f* interlaces downwardly through the bottom layer 5 to pass under and around the thread 5*e* to bind with a single thread of the lower layer. The longitudinal thread 6 then interlaces upwardly through the lower layer 5 and again runs as an interior thread for three successive groups of stacked cross machine threads to complete the weave repeat. The major portion of the length of a weave repeat of the thread 6*f* thus lies between the upper and lower cross machine layers 4, 5 as an interior thread buried inside the fabric. In the fabric 1 illustrated in the drawings each thread 6 is an interior thread at three-fourths of its crossovers, and in the practice of the invention the single layer threads are preferably in the interior position for at least two-thirds of their crossovers.

As seen in FIG. 3, each thread 4*h* and 5*h* has eight crossovers with the longitudinal threads 6*a*–6*h* in one complete repeat of its weave pattern. The thread 4*h* of the upper layer binds at the point 7 with a single thread 6*a* by interlacing downwardly through the single layer system to pass beneath and around such thread 6*a* and then interlacing upwardly back to the top of the fabric 1. The thread 4*h* then passes above seven successive threads 6*b*–6*h* at their respective crossovers to complete its weave repeat, after which it will again interlace downwardly through the threads 6 to commence the next cycle of its pattern by binding at point 8 with thread 6*i*. By the term binding, or binding point is meant the interlacing of a thread of one thread system through another thread system to pass around the opposite side of a thread or threads of such other system, and then interlacing back through the other thread system to form a relatively short knuckle that holds the thread systems together.

The threads 5*a*–5*i* of the bottom layer 5 of the multilayer thread system each have a weave repeat of eight longitudinal threads 6, and the general contour of each thread 5*a*–5*i* is substantially an inversion of the threads of the upper layer 4. As seen in FIG. 3, there is a binding point 9 at which the thread 5*h* interlaces upwardly through the single layer thread system 6 and passes above and around the single thread 6*e*, so as to bind therewith, and then back downwardly through the layer of threads 6 to return to the undersurface of the fabric 1. The binding point 9 is equally spaced in the transverse direction from the binding points 7 and 8 at which the upper thread 4*h* is in binding engagement with threads 6*a* and 6*i*. This equal spacing comprises three interior machine direction threads 6 on each side of the binding point 9 between it and the next binding point 7, 8. This produces a balanced weave pattern in which the binding points along a pair, or group of tiered cross machine threads are spaced a maximum distance from one another. While such a symmetrically balanced pattern can be achieved in a fabric having an even numbered weave repeat for the multilayer threads, in weave repeats of odd numbers, such as in a seven shaft or nine shaft fabric, an exact, symmetrical balance is not possible, but a substantial balance can be obtained in which the number of interior single layer threads to one side of a binding point differs by only one from the number of interior single layer threads on the opposite side of the binding point. The term substantial balance is used to mean this condition as well as a symmetrical balance.

As seen in FIGS. 1 and 3, the longitudinal threads 6*a* through 6*i* of the single layer thread system 6 are spaced apart from one another, and this spacing coupled with the spacing between adjacent, tiered groups of the multilayer thread system provides openings 10 (see FIG. 1) that extend straight through the fabric 1. Such openings 10 when viewed from above, or beneath the fabric provide direct lines of sight through the fabric which constitute a projected open area. The fabrics of the invention have a projected open area that may range between 13 to 25 percent of the total fabric area, which range substantially coincides with that of single layer fabrics which the invention is intended to supplant. Such an open area affords ready passage of water straight through the fabric 1, so that water showers located on one side of the fabric can impinge upon paper adhering on the opposite fabric side to lift the paper off the fabric and release it from engagement with the fabric. The open area also allows a flushing action from shower sprays to cleanse and clean the fabric during each revolution around the paper machine, to thereby inhibit the collection and permanent adhesion of contaminants that are present in the furnish from which the paper web is formed.

The spacing between the single layer threads 6 is preferably achieved by spreading the threads 6 from one another, rather than by reducing their diameters. This creates relatively longer floats for the multiple layer threads 4 and 5. This increased float length on the paper forming side of the fabric increases the prominence of the crosswise threads for supporting fibers and paper, and the short knuckles of the single layer threads need not be relied upon for fiber and paper support to the same degree as in fabrics with shorter float lengths. Thus, one aspect of the invention is the development of longer crosswise floats for improving sheet support. The spreading of the single layer threads relatively reduces the single layer thread count, and the ratio of single layer thread count to the thread count of a layer of the multilayer thread system may be 1.4 and lower.

As an example of the invention, a fabric was woven flat with the warp threads in the loom comprising the single layer thread system 6. Such threads were 0.35 mm (0.0138 inch) in diameter of usual polyester monofilament. The upper and lower shute threads 4, 5 forming the two crosswise layers of the multiple layer thread system were polyester monofilaments each having a diameter of 0.40 mm (0.0157 inch). The upper layer 4 was of a relatively stiffer monofilament than the lower layer, which was of a usual material. The final mesh count for the single layer of warp threads 6 was forty-three threads per inch, and for each layer 4, 5 of shute threads was 35 per inch. These dimensions provide a calculated projected open area of 18.3 percent. The density of the warp, or single layer thread system was 0.593, and that of the shute, or multiple layer system (assuming perfect stacking) was 0.55. For fabrics of the invention the single layer thread density is preferably within a range of about 0.50 to 0.65.

The finished fabric had a difference between the knuckle heights of the warp (longitudinal) threads 6 and shute (crosswise) threads 4 on the upper, or paper side of the fabric of 0.0085 inch, with the shute extending above the warp. This plane difference is represented by the distance 11 in FIGS. 2 and 3. On the lower, or wear side of the fabric the shute (crosswise) knuckles extended 0.0120 inch outside of the warp (longitudinal) knuckles to be the major wearing elements of the fabric, and the plane difference on the wear side is represented by the distance 12 in FIGS. 2 and 3. The total fabric thickness was 0.0595 inch, the fabric had a high resistance to stretching, and the air permeability was 758 cubic feet per minute per square foot at 0.5 inch of water pressure drop. This latter figure compares favorably with single mesh fabrics, and indicates a greater opening for water drainage than in prior multilayer fabrics.

Referring again to the balanced binding point positions shown in FIG. 3, the number of interior threads 6 between the binding point 7 and the binding point 9 comprises a set of three threads 6*b*, 6*c* and 6*d*. On the opposite side of the binding point 9, the number of interior threads 6 between the binding points 9 and 8 comprises a second set of three threads 6*f*, 6*g* and 6*h*. This results in a substantial spacing between binding points 7, 8, 9 along the lengths of the stacked threads 4*h*, 5*h*. As a result, the lateral forces acting upon the single layer threads 6 that are created by the interlacings of the multiple layer threads 4*h*, 5*h* through the single layer is minimized. These forces tend to develop lateral crimp in the threads 6, and by minimizing the lateral forces undesirable lateral crimp in the single layer threads 6 is avoided to obtain substantially straight threads. This results in substantially rectangular openings 10 in the fabric. To achieve a minimal lateral crimp in the thread system 6 the number of interior single layer threads 6 between successive binding points along the upper and lower threads of a stacked group in the multilayer thread system is preferably at least two threads. In the embodiment of the drawings, the number is shown as three, which has provided good minimization of lateral crimp in the single layer thread system.

A method of measuring lateral crimp of a thread is illustrated in FIG. 4, which shows an isolated thread 6 of the single layer system as viewed from above, or in the plane of the fabric. For illustration, the curvature of this thread 6 is exaggerated. An envelope within which the thread 6 lies is defined by the tangent lines 13 on opposite sides of the thread 6. If the thread diameter D is subtracted from the width of the envelope E, and the remainder is then divided by the diameter D the result is a dimensionless value for lateral crimp. For fabrics of the invention lateral crimp can be held within a value of 0.33 and less.

Figure 5:
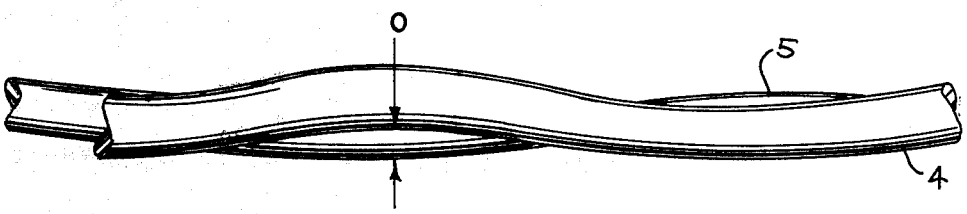
FIG. 5 is a top view of a pair of stacked threads in the multilayer thread system of the fabric.

A high degree of stacking for vertical groups in the multiple layer thread system is another characteristic of preferred forms of the invention. In FIG. 5 there is represented a stacked group of threads of the multiple layer thread system as seen from above, or in the plane of the fabric. They comprise one thread 4 from the upper layer and its paired underlying thread 5 from the lower layer. The curvature of these two threads and of the sideward offsets O between the threads are exaggerated for the purpose of illustration. In a perfect stacking of one thread 4 above its mate 5 there would be no offsets O. The degree of offset, or stacking factor, at any point along the length of two threads 4, 5 of like diameter can be calculated by dividing the offset O by the thread diameter. The maximum stacking factor for a fabric like that of FIG. 1 should not exceed a value of 0.4, and the average value along the thread lengths should not exceed a value of 0.2. If the upper and lower threads in the multiple layer thread system are of different diameters, then the stacking factor is determined by measuring the offset O of the smaller thread and dividing by the average of the two diameters.

The use of a relatively stiff thread material for the upper layer 4 in the multiple layer thread system causes the thread knuckles of the single layer thread system 6 to be more elevated at their binding points, so as to rise toward the plane of the knuckle crests of the upper layer of the multiple layer thread system. This may further improve fiber and sheet support. The stiffer material has also been found to reduce lateral crimp in the multilayer threads and improve stacking. Stiffness is indirectly related to tensile strength, and measurements of loads to produce one percent of thread elongation at uniform diameters have been made for threads of the multilayer system. The ratio of this tensile measurement of stiffer upper layer threads to less stiff lower layer threads has ranged upwardly to a value of 2.25.

Referring now to FIG. 5, this graph represents the void volume of a fabric having a single layer thread system formed of 43 warp threads per inch of 0.35 mm diameter, and a multiple layer thread system comprised of 0.35 mm diameter shute woven in 35 threads per inch for each layer. The ordinate of the graph represents depth within the fabric, and indicates that the fabric had a thickness of 1.33 mm. The lower scale on the abscissa represents in percent the solid cross section area of the fabric, and the upper scale on the abscissa represents in percent the void area, or space, within the fabric. Data for the graph was obtained by potting a sample piece of fabric in a suitable resin, so as to firmly hold the fabric threads in place, and then carefully grinding away the fabric and at successive levels measuring the area occupied by the threads.

The upper curve 14 represents the upper shute, or layer 4, of the multiple layer thread system, with area to the left of the curve being the solid fraction represented by such upper layer. The lower curve 15 represents the lower shute, or layer 5 of the multiple layer thread system, and the middle curve 16 represents the warp, or single layer thread system 6. Curve 17 is an addition of the three thread curves 14, 15, and 16, so that the space to the left of the composite curve 17 represents the total volume of the fabric threads. The space to the right of the curve 17 conversely represents the free space, or void volume within the fabric.

Figure 6:
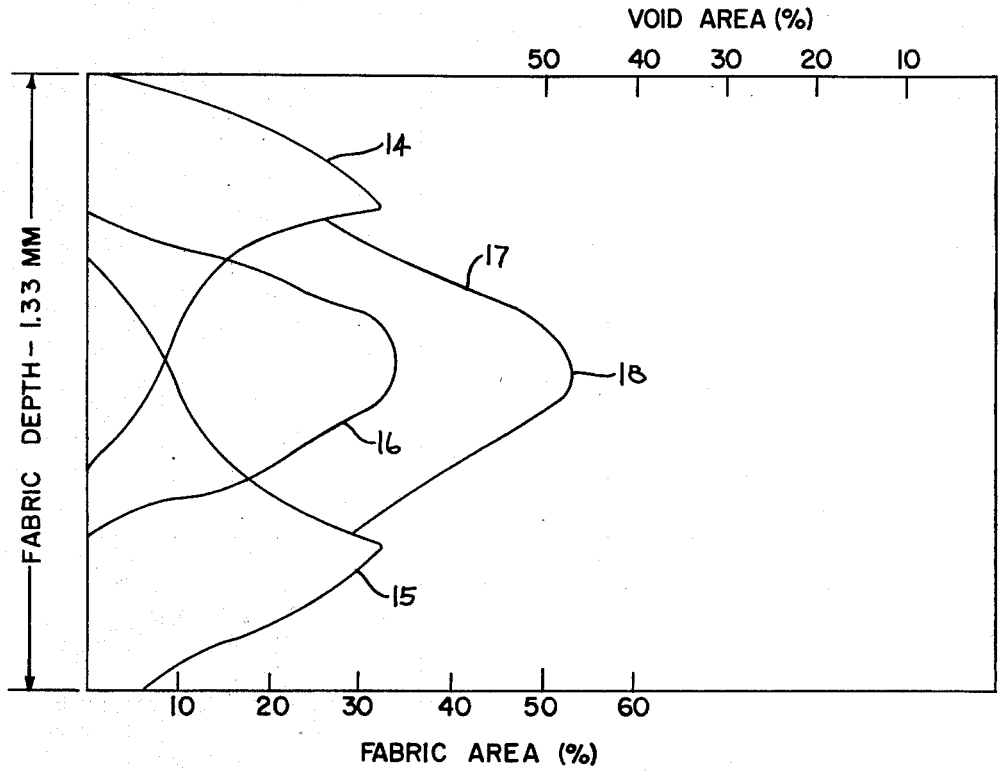
FIG. 6 is a graph illustrating the void volume within the fabric.

The point 18 of curve 17 indicates the greatest restriction within the fabric to water flow and the level within the fabric at which such restriction occurs. The void volume within the fabric is at a maximum near the upper and lower fabric surfaces, and upon progression toward the fabric center the void volume decreases, or necks down, to the point 18. The percent of open area at this point 18 is a major determinant of the drainage and flow characteristics of the fabric, and in the graph of FIG. 6 the smallest void volume is about 47%. This contrasts with measured values for typical single layer fabrics of 25 to 32 percent, and illustrates that multilayer fabrics of the invention, in which the density of the threads of the single layer thread system is reduced, can compare favorably with the flow characteristics of single layer fabrics which they supplant. Preferably the smallest void volume at any level within fabrics of the invention is no less than forty percent.

Although the foregoing discussion has related primarily to fabrics for the forming, or wet end of a paper machine, fabrics of the invention also can be used in different sections of a papermaking machine where advantages of the invention may be realized. The invention provides a multilayer fabric of significant projected open area coupled with a substantial minimum void volume. Water flow through the fabric is greatly improved, and the use of multilayer fabrics can be extended to new applications.

I claim:

1. In a multilayer papermaking fabric having a single layer thread system with threads extending in one direction of the fabric and a multiple layer thread system with threads extending in a direction normal to the threads of the single layer system, the combination of:

threads in an upper layer of said multiple layer thread system being grouped with threads in a lower layer of said multiple layer thread system, with threads of a group being stacked one above the other;

threads of said single layer thread system interweaving with the threads of each layer of the multiple layer thread system; and the projected open area of the fabric being within 13 to 25 percent of the total fabric area.

2. A fabric as in claim 1, wherein the minimum void volume an any level within the fabric is no less than 40%.

3. A fabric as in claim 1 wherein the lateral crimp of threads in both thread systems is within a value of 0.33 as measured by subtracting the thread diameter from the width of the thread envelope in the plane of the fabric and dividing the resultant by the thread diameter.

4. A fabric as in claim 1 wherein the threads of a stacked group in the multiple layer thread system have an average stacking factor not exceeding a value of 0.2.

5. A fabric as in claim 1 wherein a thread of the single layer thread system interlaces through the upper and lower layers of the multiple thread system to pass around the outside of threads of the upper and lower layers to form knuckles that are recessed within the knuckles of the threads of the upper and lower layers.

6. A fabric as in claim 1 wherein a thread of the single layer thread system is in an interior position between the upper and lower layers of the multiple layer thread system for at least two thirds of its crossovers with said upper and lower layers.

7. A fabric as in claim 1 wherein the binding points along a stacked group of multilayer threads are spaced in a substantially balanced pattern.

8. A fabric as in claim 1 wherein the binding points along a stacked group of multilayer threads are equally spaced from one another.

9. A fabric as in claim 1 wherein a thread of the single layer thread system binds around only a single thread of the upper layer of the multiple layer thread system and around only a single thread of the lower layer of the multiple thread system in each weave repeat.

10. A fabric as in claim 9 wherein a thread of the single layer thread system has a weave repeat of eight groups of threads of the multiple layer thread system.

11. In a multilayer papermaking fabric of interwoven threads having a single layer thread system with threads extending in one direction of the fabric and a multiple layer thread system with threads extending in the other fabric direction, the combination of:

threads in an upper layer of said multiple layer thread system being horizontally spaced from one another, and threads in a lower layer of said multiple layer thread system also being horizontally spaced from one another;

threads of said single layer thread system interlacing with threads of both the upper and lower layer of said multiple layer thread system, and being spaced apart from one another with the spacing between threads being such that the thread density of the single layer thread system is within a range of about 0.50 to 0.65; and the projected open area of the fabric being within 13 to 25 percent of the total fabric area.

12. In a multilayer papermaking fabric of interwoven threads having a single layer thread system extending in one direction of the fabric and a multiple layer thread system extending in the other fabric direction, the combination of:

threads in said multiple layer system being grouped with threads of a group being stacked one above the other;

the upper thread of a group having a weave repeat pattern of passing over a number of threads of the single layer system and then passing under a thread of the single layer system to bind with the single layer thread system;

the lower thread of a group having a weave repeat pattern of passing under a number of threads of the single layer system and then passing over a thread of the single layer system to bind with the single layer thread system;

the number of single layer threads residing in an interior position between a binding of the upper thread and a binding of the lower thread being at least two; and the projected open area of the fabric being within about 13 to 25 percent of the total fabric area.

13. A fabric as in claim 12 wherein the binding points along a stacked group of multilayer threads are in a substantially balanced spacing from one another.

14. In a multilayer papermaking fabric having a single layer thread system interwoven with a multiple layer thread system, the combination comprising:

threads of said single layer thread system being spaced apart from one another with the thread density of the system being within about 0.50 to 0.65; and said fabric having openings passing straight through the fabric with the resultant projected open area being within about 13 to 25 percent of the total fabric area.

15. A fabric as in claim 14, wherein the multiple layer thread system includes a thread layer with threads being stiffer than other threads of such system.

* * * * *

UNITED STATES PATENT AND TRADEMARK OFFICE

CERTIFICATE OF CORRECTION

PATENT NO. : 4,359,069

DATED : November 16, 1982

INVENTOR(S) : Edward R. Hahn

It is certified that error appears in the above—identified patent and that said Letters Patent is hereby corrected as shown below:

Column 5, line 17, after "or" ---to--- should appear

Column 5, line 68, "threaded" should read ---thread---

Column 9, line 25, "5" should read ---6---

Column 10, line 29, "an" should read ---at---

Signed and Sealed this

*Eighteenth* Day of *January 1983*

[SEAL]

*Attest:*

GERALD J. MOSSINGHOFF

*Attesting Officer*

*Commissioner of Patents and Trademarks*